United States Patent [19]

Maghon et al.

[11] Patent Number: 4,827,724

[45] Date of Patent: May 9, 1989

[54] GAS TURBINE COMBUSTION CHAMBER

[75] Inventors: Helmut Maghon, Mülheim; Wolfram Krockow, Düsseldorf, both of Fed. Rep. of Germany

[73] Assignee: Siemens Aktiengesellschaft, Munich, Fed. Rep. of Germany

[21] Appl. No.: 543,069

[22] Filed: Oct. 18, 1983

[30] Foreign Application Priority Data

Oct. 19, 1982 [DE] Fed. Rep. of Germany ..... 3238684

[51] Int. Cl.[4] ..... F02C 1/00

[52] U.S. Cl. ..... 60/731; 60/737

[58] Field of Search ..... 60/39.23, 731, 733, 60/737, 747, 722

[56] References Cited

U.S. PATENT DOCUMENTS 4,073,134 2/1978 Koch ..... 60/747

4,351,156 9/1982 White et al. ..... 60/747

*Primary Examiner*—Carlton R. Croyle

*Assistant Examiner*—Timothy S. Thorpe

*Attorney, Agent, or Firm*—Herbert L. Lerner; Laurence A. Greenberg

[57] ABSTRACT

A gas turbine combustion chamber, includes a common spherical purely mixing chamber having inlet openings and an outlet opening formed therein and being otherwise closed, the mixing chamber having a hemispherical end zone and a spherical segment zone disposed between the hemispherical end zone and the outlet opening, the inlet openings being formed in the hemispherical and spherical segment zones, a multiplicity of primary combustion chambers each being adjacent a respective one of the inlet openings for discharging into the mixing chamber, each of the primary combustion chambers having a respective longitudinal axis coinciding at least substantially at the center of the mixing chamber, a separate air supply and a separate fuel feed for each respective primary combustion chamber, the fuel feeds being switchable on and off in dependence on the load of the gas turbine.

10 Claims, 2 Drawing Sheets

GAS TURBINE COMBUSTION CHAMBER

The invention relates to a gas turbine combustion chamber, with a multiplicity of primary combustion chambers which open into a common chamber, a separate air supply for each primary combustion chamber, a separate fuel feed for each primary combustion chamber which can be switched on and off in dependence on the load, and a spherical termination of the common chamber, on which the primary chambers are disposed in such a manner that their longitudinal axes meet at least approximately at a point within the common chamber.

Such a gas turbine combustion chamber is known from German Patent DE-PS No. 24 17 147 corresponding to U.S. Pat. No. 4,073,134. The primary combustion chambers in this conventional gas turbine combustion chamber are constructed in such a way that the combustion is not completed therein. The flames therefore extend from the primary combustion chambers into the common chamber which is constructed as a secondary combustion chamber and in which a common secondary flame is produced, mixing the primary flames. The placement of the individual primary combustion chambers on a spherical termination of the secondary combustion chamber is provided in order to form a secondary flame which is as compact as possible, by intensive mixing of the primary flames; the secondary flame should also ensure reliable ignition without separate ignition devices when primary combustion chambers are added.

In order to ensure that complete combustion can take place in the secondary combustion chamber, holes are provided in the shell thereof, through which additional combustion air is transported to the common secondary flame.

The prior art gas turbine combustion chamber is advantageous because the subdivision of the combustion process into many small primary combustion chambers shortens the dwelling time of the combustion air in the high-temperature zone of the flame, which leads to a reduction in the formation of $NO_x$. In addition, advantageous mixing ratios of fuel and combustion air can be maintained even in the event of load changes by switching individual primary combustion chambers on and off. However, the $NO_x$ formation is still high enough to be troublesome.

It is accordingly an object of the invention to provide a gas turbine combustion chamber which overcomes the hereinafore-mentioned disadvantages of the heretofore-known devices of this general type, having a multiplicity of primary combustion chambers, in which the $NO_x$ formation can be reduced still further.

With the foregoing and other objects in view there is provided, in accordance with the invention, a gas turbine combustion chamber, comprising a common spherical purely mixing chamber having inlet openings and an outlet opening formed therein and being otherwise closed, the mixing chamber having a hemispherical or cup-shaped end zone and a spherical segment zone disposed between the hemispherical end zone and the outlet opening, the inlet openings being formed in the hemisperical and spherical segment zones, a multiplicity of primary combustion chambers each being adjacent a respective one of the inlet openings for discharging into the mixing chamber, each of the primary combustion chambers having a respective longitudinal axis coinciding at least substantially at the center of the mixing chamber, a separate air supply and a separate fuel feed for each respective primary combustion chamber, the fuel feeds being switchable on and off in dependence on the load of the gas turbine.

The invention is based on the insight that in the case of post-combustion, additional $NO_x$ formation takes place in the large volume of a secondary combustion chamber due to the additional dwelling time. On the other hand, in the case of a large number of primary combustion chambers, a particularly intensive mixing of the hot gas jets issuing from the primary combustion chambers (depending on the primary combustion chambers added) with the cold air jets issuing from the primary combustion chambers which are switched off, is required in view of the operating range which is narrow with respect to a low $NO_x$ formation. Accordingly, the common chamber into which the primary combustion chambers discharge, is constructed as a pure mixing chamber, for which the shape of a sphere is utilized as far as possible. Complete combustion therefore already takes place in the primary combustion chambers which have been put into operation, so that post-combustion in the mixing chamber, with additional $NO_x$ formation, is prevented. The spherical shape of the mixing chamber assures optimum mixing if the primary chambers are aligned radially. In this case, special importance is assigned to the primary combustion chambers which are disposed on the spherical segment zone facing the outlet opening, by providing a backwardly inclined alignment with respect to the main hot gas flow. It is a further advantage of the spherical shape that the surface of the sphere provides room for accomodating a very large number of primary combustion chambers. In this connection it is advantageous if, in accordance with another feature of the invention, the primary combustion chambers are disposed on mutually parallel circumferential planes disposed along a given axis of the spherical mixing chamber. A particularly space-saving accomodation is assured if, in accordance with a further feature of the invention, the primary combustion chambers disposed on adjacent mutually parallel circumferential planes disposed along the given axis are disposed on different mutually parallel circumferential planes perpendicular to the axis.

In accordance with an added feature of the invention, there is provided a cylindrical transition section downstream of the outlet opening of the mixing chamber. In this case, the connection to the gas turbine can be constructed particularly simply as an intersection of a sphere and a cylinder.

In accordance with an additional feature of the invention, there is provided a multiplicity of burners each being adjacent a respective one of the primary combustion chambers, and an outer combustion chamber shell disposed outside the mixing chamber, the outer combustion chamber shell having stubs formed therein in which the burners are disposed. The burners can then be assembled through the stubs.

In accordance with again another feature of the invention, the inner diameters of the stubs are larger than the outer diameters of the primary combustion chambers. In this case, the entire primary combustion chamber can be assembled through the stubs.

In accordance with again a further feature of the invention, there is provided an outer spherical combustion chamber shell disposed outside the mixing chamber, the outer combustion chamber shell having a central access hole formed therein associated with a closable opening formed in the mixing chamber. The mixing chamber is then accessible through the access hole and the associated opening, which particularly facilitates the inspection of the refractory lining of the primary combustion chambers and the mixing chambers.

In accordance with again an added feature of the invention, there is provided a multiplicity of pre-mixing burners each being associated with a respective one of the primary combustion chambers. Such pre-mixing burners permit operation which is particularly low in harmful substances. On the other hand, the small operating range of the pre-mixing burners as compared with diffusion burners can be maintained without problems by the particular construction of the gas turbine combustion chamber according to the invention.

In accordance with again an additional feature of the invention, there is provided a multiplicity of flame holders each being associated with an end of a respective one of the pre-mixing burners. Undesirable flashback of the mixture can be prevented and a flame-stabilizing recirculating region can be generated, by flame holders disposed at the end of the pre-mixing burners.

In accordance with yet another feature of the invention, there is provided a multiplicity of separate ignition devices each being associated with a respective one of the primary combustion chambers. In this way, reliable ignition is thus ensured if primary combustion chambers are added.

In accordance with yet a further feature of the invention, each of the primary combustion chambers have an opening formed therein leading into the mixing chamber, a combustion zone, and quenching air inlets formed therein downstream of the combustion zone and upstream of the opening. This measure is based on the insight, that even after complete combustion in the primary combustion chambers, a certain amount of post-reaction connected with $NO_x$ formation can occur in the mixing chamber. However, because quenching air is fed-in, such post-reactions are "frozen" before the reaction partners enter the mixing chamber. This effect can be further enhanced by the provision that the entire mixing air can be fed-in exclusively through the burners with the fuel supply switched off, and in the form of quenching air through the openings of the primary combustion chamber into the mixing chamber. With the exception of the mixing air flowing through the switched-off primary combustion chambers under partial-load operation, the entire amount of mixing air is therefore used as the quenching air.

In view of a combustion process that is low in harmful substances, it is also advantageous if, in accordance with a concomitant feature of the invention, the combustion air is entirely fed-in to the mixing chambers through the burners when the fuel feeds are switched on. Then, no further openings for supplying combustion air or mixing air are provided in addition to the openings for the entry of quenching air.

Other features which are considered as characteristic for the invention are set forth in the appended claims.

Although the invention is illustrated and described herein as embodied in a gas turbine combustion chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
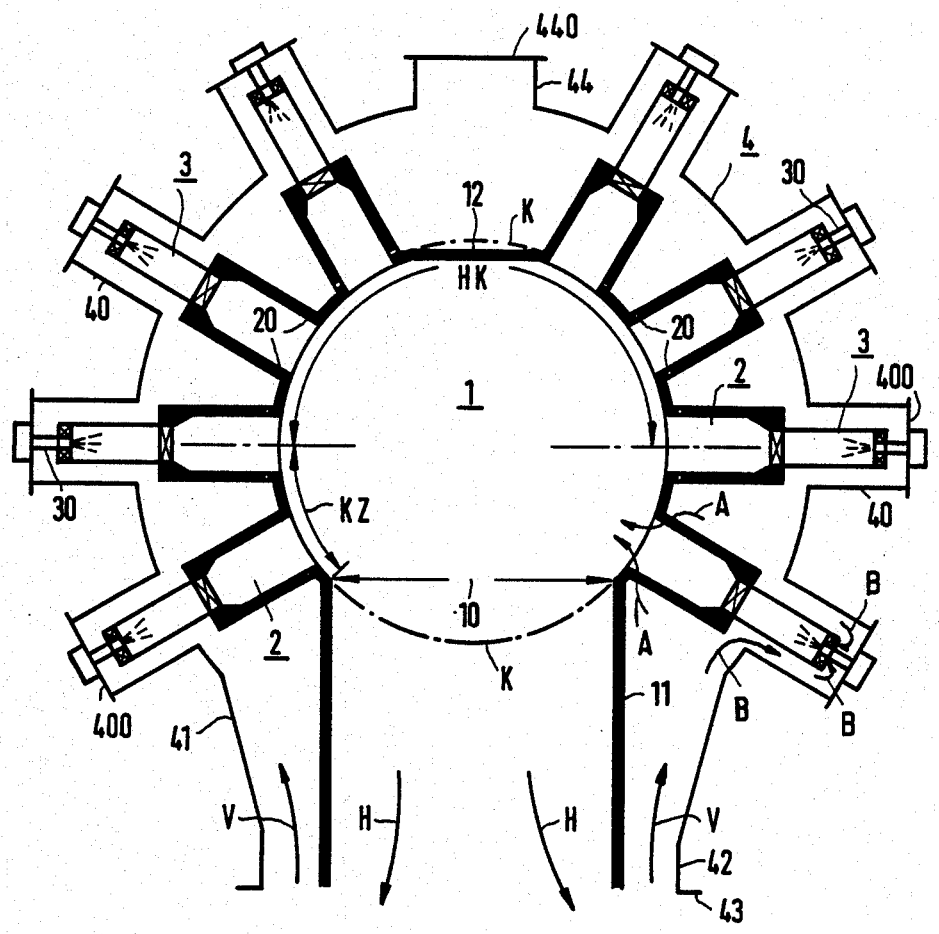
FIG. 1 is a greatly simplified, diagrammatic, longitudinal-sectional view of a gas turbine combustion chamber wuth a multiplicity of primary combustion chambers and a spherical mixing chamber.

Referring now to the figures of the drawing in detail, and first particularly to FIG. 1 thereof, it is seen that the gas turbine combustion chamber includes a mixing chamber 1 which is spherical as indicated by the broken line K, and an outlet opening 10 which is followed by a cylindrical transition section 11 establishing a connection to the gas turbine. The outlet opening 10 of the mixing chamber 1 is therefore formed by an intersection of the sphere K and the cylinder of the transition section 11. The diameter of the transition section 11 is smaller than the diameter of the sphere K and the longitudinal axis of the transition section 11 passes through the center of the sphere K. Accordingly, the jacket or shell of the mixing chamber 1 is formed of a hemisphere HK to be considered as the end of the mixing chamber and a spherical segment zone KZ disposed between the hemisphere HK and the outlet opening 10.

Figure 2:
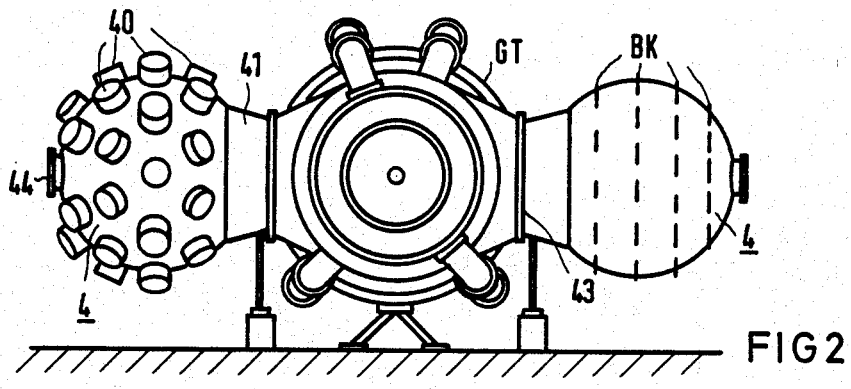
FIG. 2 is a rear-elevational view of a gas turbine with two of the gas turbine combustion chambers shown in FIG. 1.

A multiplicity of primary combustion chambers 2 which discharge into the mixing chamber 1, are disposed on mutually parallel circumferential planes disposed along a given axis of the sphere K. The longitudinal axes of the chambers 2 meet at the center of the sphere K. In the embodiment shown, five primary combustion chambers 2 are disposed on a first circumferential plane disposed along the axis of the hemisphere HK, ten primary combustion chambers 2 are disposed on a second circumferential plane disposed along the axis of the hemisphere HK, ten primary combustion chambers 2 are disposed on the equator or major circle of the sphere K, and ten primary combustion chambers 2 are similarly disposed on a circumferential plane disposed along the axis of the spherical segment zone KZ. The primary combustion chambers 2 of adjacent mutually parallel circumferential planes disposed along the axis of the sphere are always disposed on different mutually parallel circumferential planes perpendicular to the given axis; i.e. they are always offset relative to each other, as seen in FIG. 2.

Each of the primary combustion chambers 2 is equipped with a pre-mixing burner 3. Each of these pre-mixing burners 3 is immersed in a respective stub 40 of an outer combustion chamber jacket or shell 4. Respective fuel feeds 30 of the associated pre-mixing burners 3 are brought through terminating covers 400 at the end faces of the individual stubs 40. The stubs 40 are furthermore constructed in such a way that the primary combustion chambers 2 and the pre-mixing burners 3 can be installed through them.

The outer combustion chamber shell 4 is in the shape of a sphere which encloses the mixing chamber 1 with a spacing therebetween. The spacing is followed in the direction toward the gas turbine connection by a transition section 41 in the form of a truncated cone and a short cylindrical section 42 with a connecting flange 43. A central access hole 44 is provided on the side of the combustion chamber shell 4 opposite the connecting flange 43. A closable opening of the mixing chamber 1 is associated with the access hole 44. A cover 12 of the closable opening of the mixing chamber 1 can be seen in the drawing as a flattend region of the sphere K. The access hole 44 has a cover 440, and when the cover 440 is removed and the cover of the mixing chamber 1 is taken off, the mixing chamber 1 becomes accessible. This particularly facilitates the inspection of the refractory lining of the mixing chamber 1 and the individual primary combustion chambers 2.

Compressed air indicated by arrows V is supplied through the annular space between the cylindrical transition section 11 of the mixing chamber 1 and the cylindrical section 42 of the combustion chamber shell 4. The compressed air V then travels into the space between the mixing chamber 1 and the sperical segment region of the combustion chamber shell 4 and is divided there into burner air indicated by arrows B and quenching air indicated by arrows A. In the case of the pre-mixing burners 3 with the fuel feed 30 activated, the burner air B is transported as combustion air into the pre-mixing burners 3 and the primary combustion chambers 2. In the case of the pre-mixing burners 3 with the fuel feed 30 shut off, the burner air B is transported through the pre-mixing burners 3 and the primary combustion chambers 2 into the mixing chamber 1 as mixing air. The quenching air A travels into the primary combustion chambers 2 through openings 20 formed in the end region of the primary combustion chambers 2, and it immediately thereafter travels into the mixing chamber 1. In the mixing chamber 1, intensive mixing takes place between hot gas jets issuing from the respectively switched-on primary combustion chambers 2, and cold air jets issuing from the respectively shut-off primary combustion chambers 2. The hot gas flow, which is cooled down to the turbine entry temperature, then leaves the mixing chamber 1 through its outlet opening 10 and flows through the transition section 11 to the inner housing of the gas turbine, as indicated by the arrows H. In full-load operation, only the hot gas jets (which already carry the mixed air supplied as the quenching air A with them) are mixed together in the mixing chamber 1. In the case of partial-load operation, the cold air jets fed-in through the shut-off primary combustion chambers 2 are also included in this mixture. The mixing becomes particularly intensive due to the spherical shape of the mixing chamber 1 and the radial alignment of the hot gas jets and the cold air jets present in partial-load operation. In particular, this intensive mixing is optimized by the primary combustion chamber 2 disposed on the spherical segment zone KZ of the mixing chamber 1, since their longitudinal axes are inclined backwards relative to the principal direction of the hot gas flow H.

FIG. 2 shows the disposition of two gas turbine combustion chambers constructed in accordance with FIG. 1 on opposite sides of a gas turbine designated as a whole with reference symbol GT. The physical placement of the stubs 40 and the access hole 44 on the spherical combustion chamber enclosure or shell 4 can be seen for the gas turbine combustion chamber shown at the left in the drawing. In the gas turbine combustion chamber shown at the right in FIG. 2, the stubs 40 have been omitted in order to illustrate their placement on a total of four mutually parallel circumferential planes BK disposed along the axis of the sphere and on the surface of the spherical combustion chamber shell 4.

Figure 3:
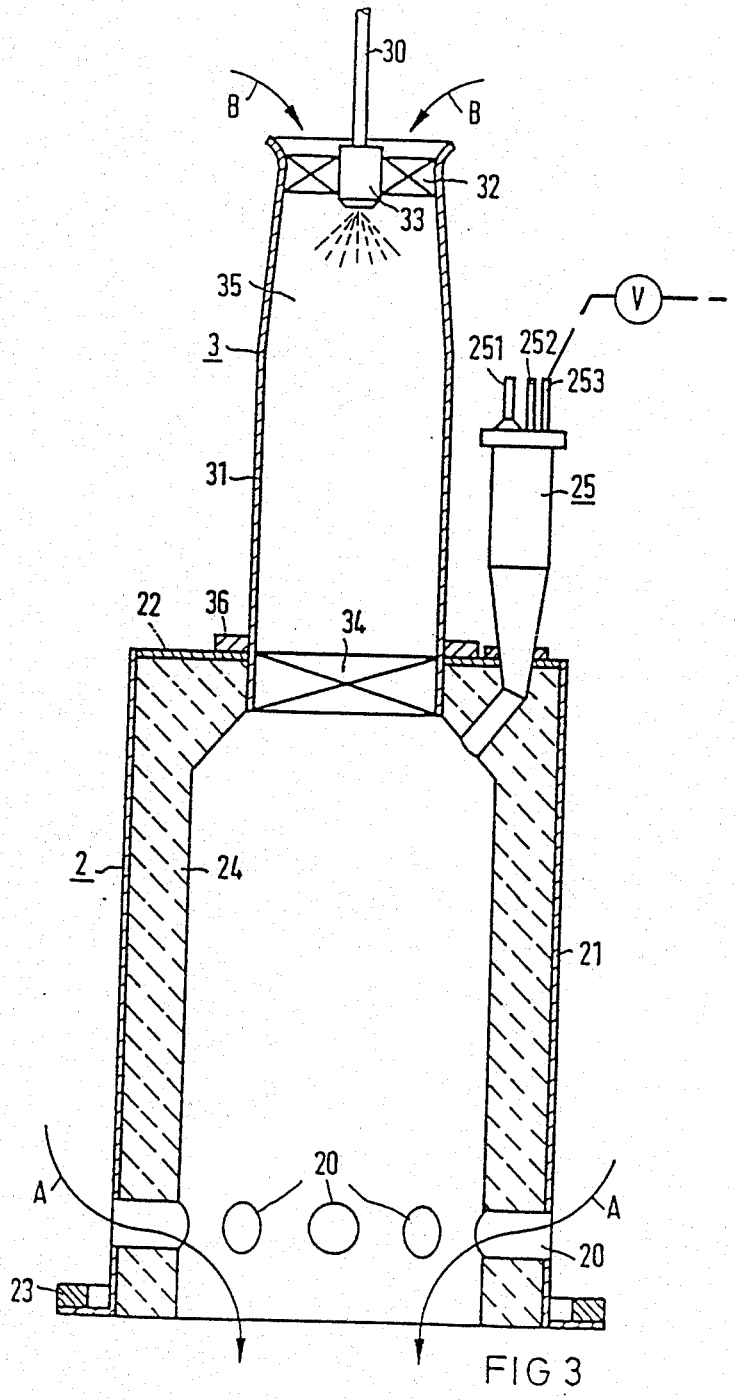
FIG. 3 is a longitudinal-sectional view of a primary combustion chamber of the gas turbine combustion chamber shown in FIG. 1.

FIG. 3 shows a longitudinal section through a primary combustion chamber 2 and the associated pre-mixing burner 3. The primary combustion chamber 2, which may also be referred to as a flame tube, is formed of a cylindrical flame tube jacket or shell 21. A cover 22 is disposed at one end surface, and a connecting flange 23 is disposed at the other end of the flame tube shell 21. The cover 22 at the end surface has a central opening formed therein through which the pre-mixing burner 3 discharges into the primary combustion chamber 2. The primary combustion chamber 2 is provided with a refractory lining 24. The cover 22 has a further opening formed therein which is located further toward the outer edge. An ignition burner 25 leads into the primary combustion chamber 2 through the further opening and the refractory lining 24. An ignition electrode 251, an air feed 252 and a gas feed 253, can be seen at an upper terminating flange of the ignition burner 25. A valve V enables the fuel feed 253 to be switchable on and off.

The openings 20 for the entry of the quenching air A are oriented radially and pass through the flame tube shell 21 and the refractory lining 24. The openings 20 are formed in the end region of the primary combustion chamber 2, which is fastened to the mixing chamber 1 shown in FIG. 1, by the connecting flange 23.

The pre-mixing burner 3 is formed of a substantially cylindrical burner housing 31 which supports a swirl body 32 and a fuel nozzle 33 at one end surface, and which supports a flame holder 34 at the other end surface thereof. In a pre-mixing chamber 35 formed between the swirl body 32 and the flame holder 34, liquid fuel which is fed-in through the fuel feed 30 and is atomized in the fuel nozzle 33, is evaporated and mixed with the burner air B. In order to ensure that this mixing is as intensive as possible, the burner air is made turbulent as it flows through the swirl body 32. The homogeneous mixture formed of the fed-in burner air B and the evaporated fuel, is only ignited by the ignition burner 25 in the primary combustion chamber 2, the flame holder 34 serving to stabilize the flame but nevertheless preventing the flame from flashing back into the pre-mixing chamber 35. A flange 36 is secured on the cover 22 of the primary combustion chamber 2 in a thermally elastic manner, for fastening the pre-mixing burner 3.

If gaseous fuels are used, a homogeneous mixture with the burner air B is likewise formed within the pre-mixing chamber 35; pre-evaporation is then omitted, of course. In lieu of the ignition burner 25, an electric ignitor can optionally be used as well for igniting the mixture in the primary combustion chamber 2.

The combustion of the mixture generated in the pre-mixing burner 3 is completely finished within the primary combustion chamber 2, when it is still ahead of the openings 20 for the entry of the quenching air A; only extremely small amounts of $NO_x$ are formed due to the extremely short dwelling time of the burner air B in the flame zone. The quenching air A which is fed-in directly after the combustion zone, cools off the hot gases and prevents a further increase of nitrous oxides by freezing-in the $NO_x$ -formation reactions.

We claim:

1. Gas turbine combustion chamber, comprising a common substantially spherical purely mixing chamber having a given number of inlet openings and an outlet opening formed therein and being otherwise closed, said mixing chamber having a hemispherical end zone and a spherical segment zone disposed between said hemispherical end zone and said outlet opening, said inlet openings being formed in said hemispherical and spherical segment zones, a multiplicity of primary combustion chambers equal to said given number being disposed in said hemispherical and spherical segment zones and each being adjacent a respective one of said inlet openings for discharging into said mixing chamber, each of said primary combustion chambers having a respective longitudinal axis coinciding at least substantially at the center of said mixing chamber, a separate air supply and a separate fuel feed for each respective primary combustion chamber, said fuel feeds being switchable on and off in dependence on the load of the gas turbine, a multiplicity of pre-mixing burners each being adjacent a respective one of said primary combustion chambers, an outer combustion chamber shell disposed outside said mixing chamber, said outer combustion chamber shell having stubs formed therein in which said burners are disposed, and a multiplicity of flame holders each being associated with an end of a respective one of said pre-mixing burners.

2. Gas turbine combustion chamber according to claim 1, wherein said spherical mixing chamber has a given axis and mutually parallel circumferential planes disposed along said given axis, and said primary combustion chambers are disposed on said mutually parallel circumferential planes disposed along said given axis of said spherical mixing chamber.

3. Gas turbine combustion chamber according to claim 2, wherein said spherical mixing chamber has mutually parallel circumferential planes perpendicular to said given axis, and said primary combustion chambers disposed on adjacent mutually parallel circumferential planes along said given axis are disposed on different mutually parallel circumferential planes perpendicular to said given axis.

4. Gas turbine combustion chamber according to claim 1, including a cylindrical transition section downstream of said outlet opening of said mixing chamber.

5. Gas turbine combustion chamber according to claim 1, wherein the inner diameters of said stubs are larger than the outer diameters of said primary combustion chambers.

6. Gas turbine combustion chamber according to claim 1, including an outer spherical combustion chamber shell disposed outside said mixing chamber, said outer combustion chamber shell having a central access hole formed therein associated with a closable opening formed in said mixing chamber.

7. Gas turbine combustion chamber according to claim 1, including a multiplicity of separate ignition devices each being associated with a respective one of said primary combustion chambers.

8. Gas turbine combustion chamber according to claim 1, wherein each of said primary combustion chambers have an opening formed therein leading into said mixing chamber, a combustion zone, and quenching air inlets formed therein providing said separate air supply downstream of said combustion zone and upstream of said opening leading into said mixing chamber.

9. Gas turbine combustion chamber according to claim 8, wherein said pre-mixing burners have other air inlets, and said quenching air inlets and said other air inlets of said pre-mixing burners form the only air inlets into said mixing chamber when said fuel feeds are switched off.

10. Gas turbine combustion chamber according to claim 1, wherein said separate air supply of each primary combustion chamber forms a quenching air inlet into said mixing chamber and said pre-mixing burners have other air inlets which form the only combustion air inlet into said mixing chamber when said fuel feeds are switched on.

* * * * *